US006439259B1

(12) United States Patent
Beaver

(10) Patent No.: US 6,439,259 B1
(45) Date of Patent: Aug. 27, 2002

(54) AIR VALVE CLOSURE FOR CONTAINERS

(76) Inventor: Jeffrey L. Beaver, 2840 Corey Dr., Indianapolis, IN (US) 46227

( * ) Notice: Subject to any disclaimer, the term of this patent is extended or adjusted under 35 U.S.C. 154(b) by 0 days.

(21) Appl. No.: 09/599,021

(22) Filed: Jun. 21, 2000

Related U.S. Application Data

(60) Provisional application No. 60/140,222, filed on Jun. 22, 1999.

(51) Int. Cl.[7] ..... F16K 15/14; B65D 81/08

(52) U.S. Cl. ..... 137/232; 137/223; 206/522

(58) Field of Search ..... 137/231, 232, 137/223; 206/522

(56) References Cited

U.S. PATENT DOCUMENTS 886,316 A * 4/1908 Dunn ..... 137/223
1,166,690 A * 1/1916 Kahn ..... 137/223
1,266,482 A * 5/1918 Kamrass ..... 137/223
1,372,878 A * 3/1921 Harder ..... 137/223
2,977,973 A * 4/1961 Chakine ..... 137/223
5,121,840 A * 6/1992 Schram ..... 206/522
5,288,188 A * 2/1994 Vance ..... 206/522 X
5,450,963 A * 9/1995 Carson ..... 206/524.8

* cited by examiner

*Primary Examiner*—John Rivell
(74) *Attorney, Agent, or Firm*—McDonald, Hopkins, Burk & Haber Co., L.P.A.

(57) ABSTRACT

A closure for a container incorporating an air valve to facilitate inflation of a bladder within the container. The closure includes a plug for sealing an opening with the container lid. The plug has a central aperture within which is seated a valve adapter. Extending through the aperture and engaging the valve adapter is a valve stem fluidly connected to an inflatable bladder. The valve adapter maintains the valve stem above the closure for connection to an air supply for inflation of the bladder. A cap snap-fits over the adapter and valve stem to protect the valve from contaminants and damage. The bladder is inflated after the container has been filled.

7 Claims, 4 Drawing Sheets

AIR VALVE CLOSURE FOR CONTAINERS

RELATED APPLICATIONS

This application claims priority from U.S. Provisional Application No. 60/140,222 filed on Jun. 22, 1999.

BACKGROUND OF THE INVENTION

Field of the Invention

This invention relates to closures for a container and, in particular, for a closure incorporating a valve stem for inflating a bladder positioned within the container behind the closure to provide added support to the container lid.

SUMMARY OF THE PRESENT INVENTION

It has been recognized that, for space and storage considerations, it is more economical to stack containers one on top of the other. One primary disadvantage of stacking larger containers, however, is the weight that must be borne by the containers at the bottom of the stack. Even in situations where the containers can support the weight, the container lids may not be strong enough. This problem is particularly acute when plastic containers having plastic tops or using plastic lids are employed.

The present invention overcomes this particular disadvantage by providing a container closure having a valve stem associated with an inflatable bladder positioned beneath the container top. Once inflated, this bladder presses against the material within the container and the underside of the top of the container and provides structural support for the top of the container.

The closure of the present invention includes a threaded plug adapted to be received within a corresponding opening of the container lid. The plug has a central aperture through which a valve stem extends to facilitate access to the valve stem exteriorly of the closure. Seated within the aperture of the plug is a valve adapter which forms a housing for the stem. The valve adapter is snap-fit into the aperture and the valve stem is threadably received within the adapter. A removable cap fits over the stem and adapter to protect against contaminants and damage to the valve.

The valve stem forms a part of an inflatable bladder adapted to support the container lid. However, the closure plug, including the valve and bladder, may be removed to allow access to the materials within the container. Following filling of the container, the container lid, with the closure installed and the bladder on the underside of the lid, is mounted to the container. The valve stem is used to inflate the bladder positioned between the container contents and container lid in order to provide support for the lid. When it becomes necessary to access the container contents, the closure is removed to expose the opening and the container contents.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
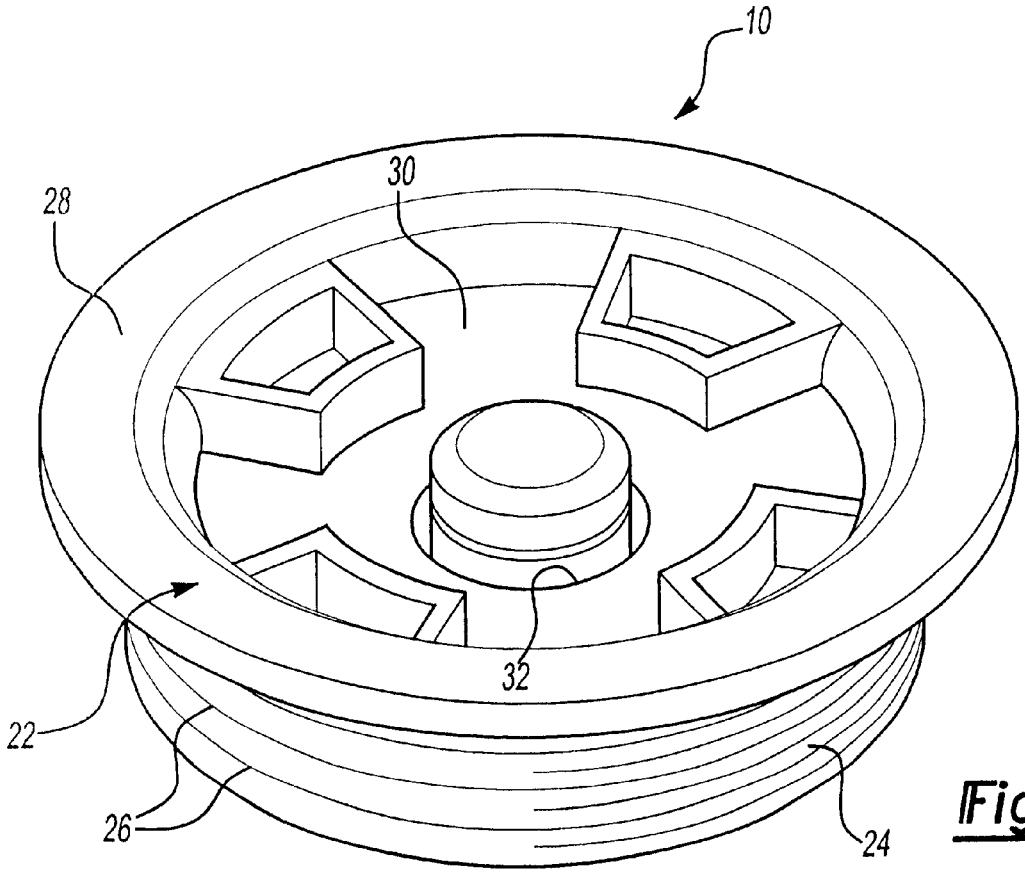
FIG. 1 is a perspective view of an assembled air valve closure for a container.
Figure 2:
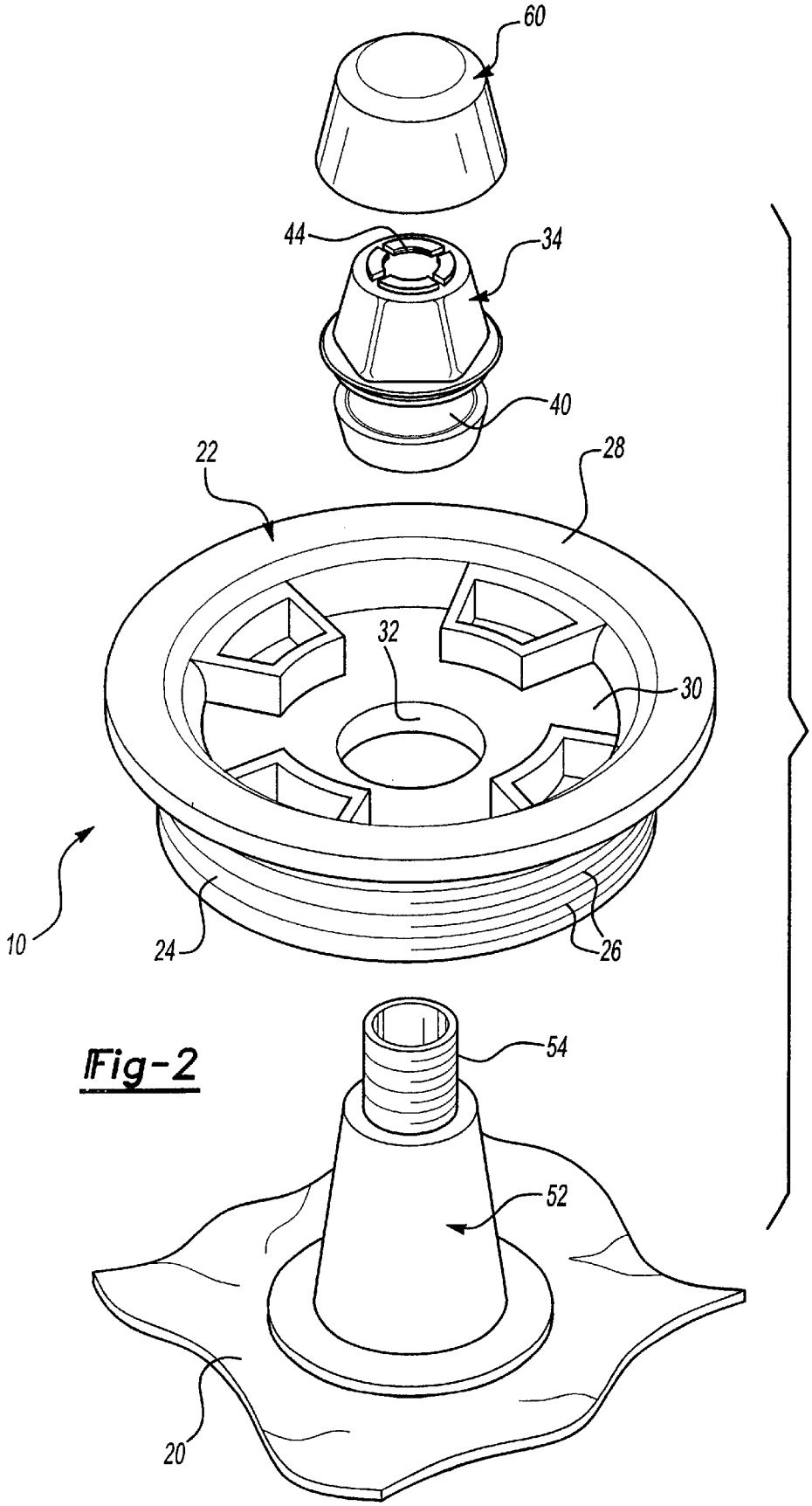
FIG. 2 is an exploded view of the closure.

Referring first to FIG. 1 and 2, there is shown a closure 10 for sealing a correspondingly sized opening of a container. The container, for example a drum, may have a separate lid attached thereto. The container lid incorporating the closure 10 is secured to the container after the container has been filled with the desired material. To make the best use of space during storage and transporting of the containers, the containers are stacked such that the container lid must bear the weight of the containers stacked above. While it is desirable to utilize plastic containers, the plastic container lid may not provide sufficient support. An inflatable bladder 20 is employed to provide added support for the container lid. The closure 10 of the present invention provides a convenient means for inflating the bladder 20 after the container has been filled, as part of the final assembly of the container.

Referring to FIG. 1, the closure 10 comprises a plug 22, a valve adapter 34, a valve stem 52, and an over cap 60. The plug 22 has an annular sidewall 24 with external threads 26 and an outwardly disposed annular flange 28. A center disc 30 extends across the plug 22 between the sidewall 24. A central aperture 32 is formed in the plug 22.

Figure 3:
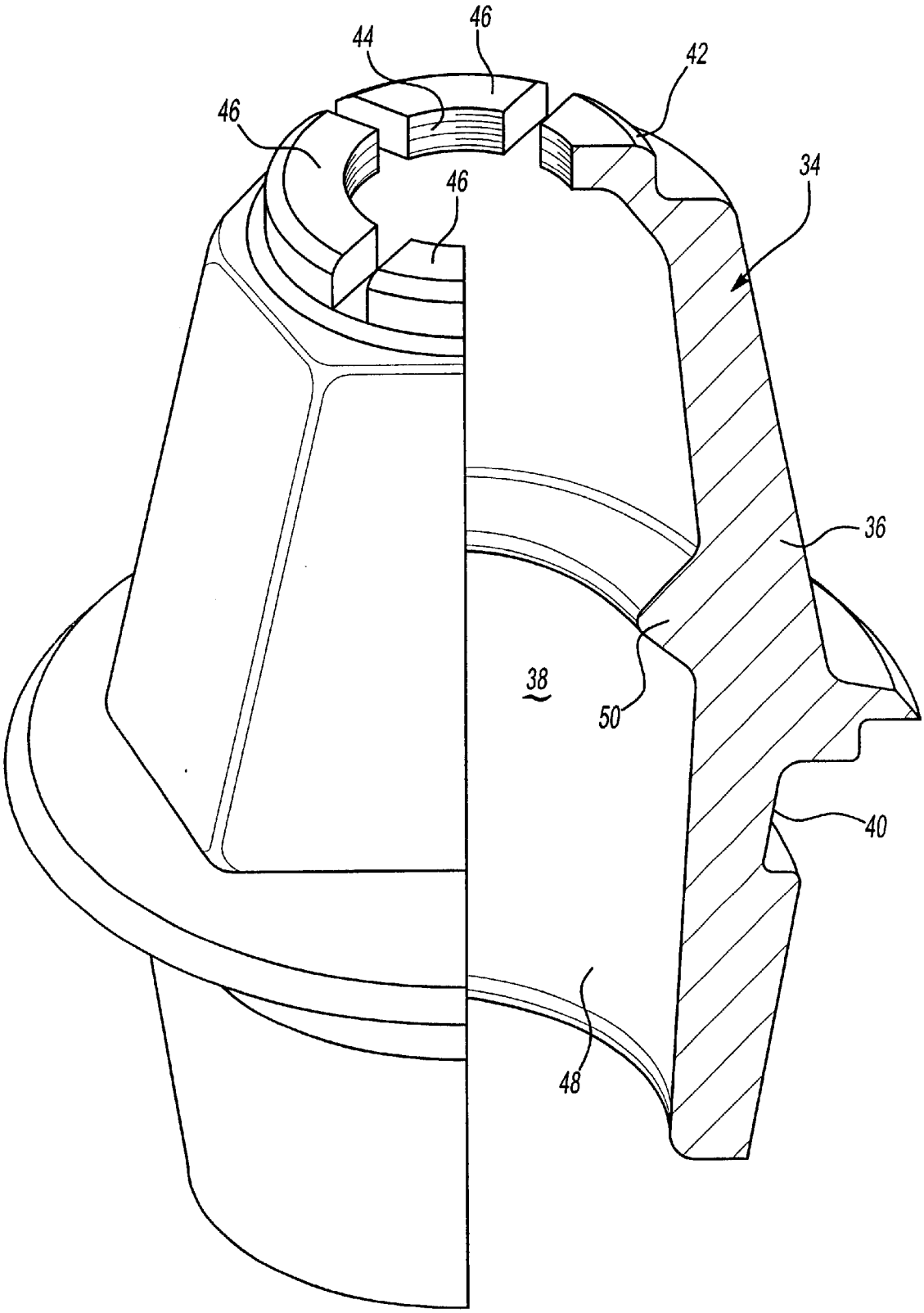
FIG. 3 is a partial cross-sectional view of the valve adapter.

A valve adapter 34 is seated within the central aperture 32. The adapter 34, shown in FIGS. 2 and 3, has a substantially tubular construction with an outer wall 36 surrounding a central passageway 38. An annular groove 40 formed in the exterior of the wall 36 is designed to engage the aperture 32 of the plug 22, thereby securing the valve adapter 34 to the plug 22. The upper or outer end 42 of the adapter 34 includes a threaded aperture 44. The threaded aperture 44 may be segmented 46 to accommodate variations in the size of the inserted valve stem as will be subsequently described. Formed on the interior surface 48 of the adapter 34 is a radial bead or single helical bead 50.

Figure 4:
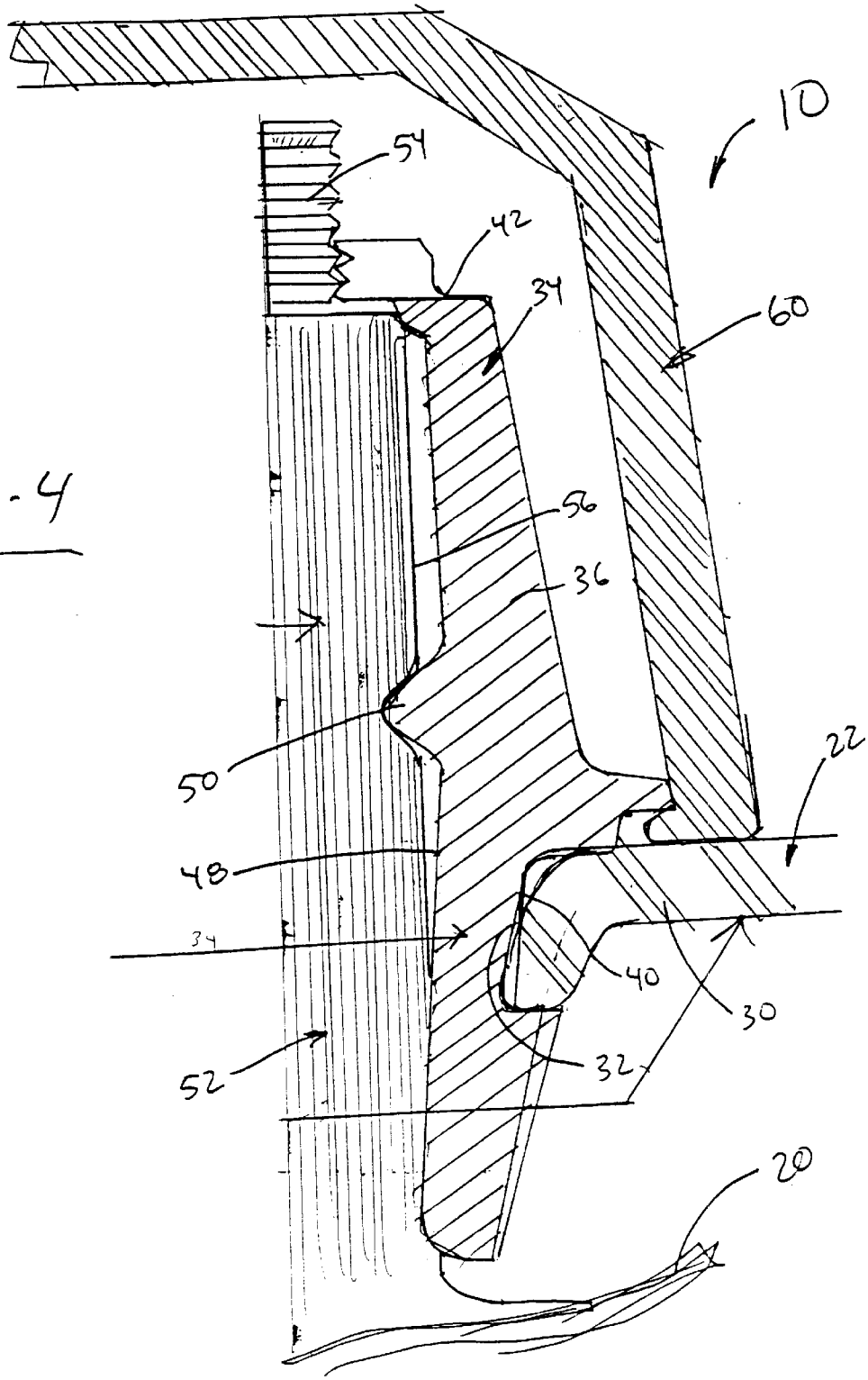
FIG. 4 is a partial cross-sectional view of the closure.

A valve stem 52 for selectively inflating the bladder 20 is removably received within the valve adapter 34 and connects the bladder 20 to the closure 10. As is best shown in FIG. 4, the valve stem 52 is matingly received within the valve adapter 34. A threaded nipple 54 threadably engages the aperture 44 while the bead 50 engages the side wall 56 of the stem 52. In this position, the valve stem 52 is positioned with its nipple 54 protruding through the aperture 44 for engagement with an inflating device (not shown).

In order to protect the valve stem 52 and prevent contaminants from fouling the stem 52, an over cap 60 may be provided. In a preferred embodiment, the over cap 60 detachably engages the adapter 34 to enclose the adapter 34 and valve stem 52.

The foregoing detailed description has been given for clearness of understanding only and no unnecessary limitations should be understood therefrom as some modifications will be obvious to those skilled in the art without departing from the scope of the appended claims.

What is claimed is:

1. A plastic closure for a container, comprising:

a plug having a planar top wall portion, and an annular skirt portion depending from the top wall portion, the top wall portion having a central aperture therein;

a valve adapter received within the central aperture of the plug, the valve adapter having a central passageway therethrough;

a valve stem having a top end and a bottom end, the valve stem being adapted to be received by and retained within the central passageway of the valve adapter; and an inflatable bladder secured to the bottom end of the valve stem, such that the bladder may be inflated through the valve stem when the valve stem is assembled within the closure.

2. The plastic closure as described in claim 1, further comprising an over cap that is removably secured to the top end of the valve stem.

3. The plastic closure as described in claim 1, wherein the annular skirt portion of the plug has external threads thereon for the threaded attachment to the container.

4. The plastic closure as described in claim 1, wherein the valve adapter has a top portion and a bottom portion, the top portion of the valve adapter having an internal thread configuration for the threaded attachment to the valve stem.

5. The plastic closure as described in claim 4, further comprising a nipple protruding from the top end of the valve stem, the nipple have an external thread configuration thereon.

6. A plastic closure for a container, comprising:

a plug having a planar top wall portion having a central aperture therein, and an annular skirt portion depending from the top wall portion, the annular skirt portion having external threads thereon;

a valve adapter having a top portion, a bottom portion, and a central passageway therethrough, the top portion of the valve adapter having an internal thread configuration, and the valve adapter being received within the central aperture of the plug;

a valve stem having a top end, a bottom end, and a nipple extension protruding from the top end of the valve stem, the nipple extension having an external thread configuration thereon, the valve stem being adapted to be received by and retained within the central passageway of the valve adapter; and an inflatable bladder secured to the bottom end of the valve stem, such that the bladder may be inflated through the valve stem when the valve stem is assembled within the closure.

7. The plastic closure as described in claim 6, further comprising an over cap that is removably secured to the top end of the valve stem.

* * * * *